US009423722B2

(12) United States Patent
Okuda

(10) Patent No.: US 9,423,722 B2
(45) Date of Patent: Aug. 23, 2016

(54) TONER CARTRIDGE, IMAGE FORMING UNIT, AND IMAGE FORMING APPARATUS

(71) Applicant: Sharp Kabushiki Kaisha, Osaka-shi, Osaka (JP)

(72) Inventor: Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/678,087

(22) Filed: Apr. 3, 2015

(65) Prior Publication Data

US 2015/0301481 A1 Oct. 22, 2015

(30) Foreign Application Priority Data

Apr. 17, 2014 (JP) ..... 2014-085441

(51) Int. Cl.
*G03G 15/08* (2006.01)

(52) U.S. Cl.
CPC ..... *G03G 15/0891* (2013.01); *G03G 15/0865* (2013.01); *G03G 2215/0802* (2013.01)

(58) Field of Classification Search
CPC ..... G03G 15/0865; G03G 15/0879; G03G 15/0877; G03G 15/0839; G93G 15/0822
See application file for complete search history.

(56) References Cited

U.S. PATENT DOCUMENTS 7,764,908 B2 * 7/2010 Hatakeyama ..... G03G 15/0844 399/254
8,750,765 B2 * 6/2014 Watanabe ..... G03G 15/0839 399/256
2012/0263496 A1 * 10/2012 Morita ..... G03G 15/0868 399/119

FOREIGN PATENT DOCUMENTS

JP 2011-081215 A 4/2011

* cited by examiner

*Primary Examiner* — Gregory H Curran
(74) *Attorney, Agent, or Firm* — Keating & Bennett, LLP

(57) ABSTRACT

Provided is a toner cartridge comprising: a toner storage case configured to store toner; and an auger screw rotatably supported in the toner storage case and configured to convey the toner stored in the toner storage case, wherein the toner storage case comprises: a first supporting portion that rotatably supports a downstream end along a toner conveyance direction of the auger screw; a second supporting portion that rotatably supports an upstream end along the toner conveyance direction of the auger screw; a discharge port provided at a downstream side along the toner conveyance direction and below the first supporting portion so as to discharge therefrom the toner conveyed by the auger screw; and an inclined portion that is provided above the discharge port and inclines by a predetermined angle from a plane perpendicular to a rotating shaft of the auger screw toward an upstream side along the toner conveyance direction.

11 Claims, 7 Drawing Sheets

TONER CARTRIDGE, IMAGE FORMING UNIT, AND IMAGE FORMING APPARATUS

TECHNICAL FIELD

The present invention relates to a toner cartridge for supplying toner, an image forming unit including the toner cartridge, and an image forming apparatus including the image forming unit.

BACKGROUND ART

An image forming apparatus adopting the electrophotographic method transfers an image formed on a photoreceptor drum onto a sheet, and then heats and presses the sheet to fix the toner image on the sheet. In the image forming apparatus adopting the electrophotographic method, toner should be supplied when toner is used up. For this reason, the image forming apparatus adopting the electrophotographic method is generally configured to use a replaceable toner cartridge in which expendable toner is stored.

A known toner cartridge includes a stirring paddle that stirs the toner stored in a toner storage container and an auger screw that conveys the toner stored in the toner storage container to a discharge port communicating with the developing device body (for example, see JP-A-2011-081215).

The toner cartridge has a vertical wall that is perpendicular to the axis of the auger screw and is provided at a downstream end along the toner conveyance direction where the auger screw is rotatably supported. Thus, when the toner is conveyed to the vertical wall by the auger screw, the toner in the side of the discharge port falls by gravity. In contrast, the toner in the side opposite to the discharge port is likely not to fall, and thus tends to accumulate near the wall. When toner is continuously conveyed under such state, the toner is pressed against the vertical wall to be dense, and an excessive load is applied on the auger screw. As a result, the auger screw stops its rotation, and for example, tooth-skipping or the like might occur at a gear that transmits a driving force to the auger screw.

SUMMARY OF THE INVENTION

An object of the present invention is to provide a toner cartridge in which it is prevented the accumulation of toner at a downstream end along the toner conveyance direction, an image forming unit including the toner cartridge, and an image forming apparatus including the image forming unit.

According to the present invention, there is provided a toner cartridge comprising: a toner storage case configured to store toner; and an auger screw that is rotatably supported in the toner storage case and configured to convey the toner stored in the toner storage case, wherein the toner storage case comprises: a first supporting portion that rotatably supports a downstream end along a toner conveyance direction of the auger screw; a second supporting portion that rotatably supports an upstream end along the toner conveyance direction of the auger screw; a discharge port provided at a downstream side along the toner conveyance direction and below the first supporting portion so as to discharge therefrom the toner conveyed by the auger screw; and an inclined portion that is provided above the discharge port and inclines by a predetermined angle from a plane perpendicular to a rotating shaft of the auger screw toward an upstream side along the toner conveyance direction.

According to the present invention, a toner cartridge that prevents the accumulation of toner at a downstream end along the toner conveyance direction, an image forming unit including the toner cartridge, and an image forming apparatus including the image forming unit can be provided.

DESCRIPTION OF THE PREFERRED EMBODIMENTS

Figure 1:
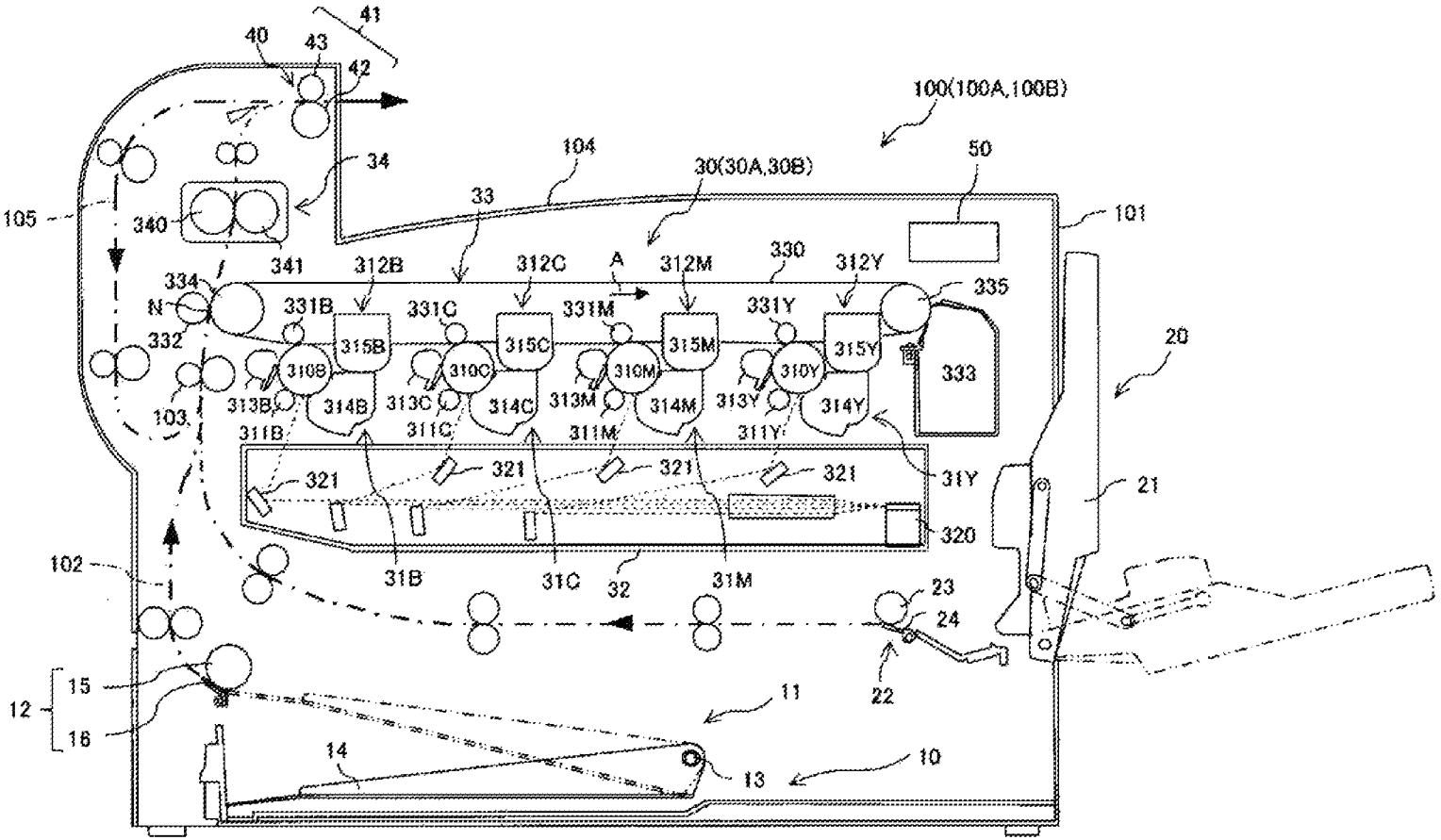
FIG. 1 is a figure illustrates a cross sectional view schematically illustrating a printer according to a first embodiment of the present invention.

An image forming apparatus according to an embodiment of the present invention will be described referring to the drawings. The image forming apparatus according to the embodiment is a copying machine, a printer, a facsimile machine, or a multifunction machine thereof. As an example of the image forming apparatus according to the embodiment, a color laser beam printer adopting the electrophotographic method (hereinafter referred to as "printer") 100 will be described.

First Embodiment

A printer 100 according to a first embodiment of the present invention will be described referring to FIGS. 1 to 6C. A schematic configuration of the printer 100 will be described referring to FIG. 1. FIG. 1 is a cross sectional view schematically illustrating the printer 100 according to the first embodiment of the present invention.

As illustrated in FIG. 1, the printer 100 includes a sheet feeding section 10 that feeds sheets, a manual-feed unit 20 configured to enable manually feeding of sheets, an image forming section 30 that forms an image on a sheet fed from the sheet feeding section 10 or the manual-feed unit 20, a sheet discharge section 40 that discharges a sheet with an image formed thereon out of the apparatus, and a controller 50 that controls these components.

The sheet feeding section 10 includes a feeding sheet stacking part 11 storing a stacked sheets to be fed and a separately feeding part 12 that feeds sheets stacked on the feeding sheet stacking part 11 one by one. The feeding sheet stacking part 11 includes a pivot tray 14 that pivots about a pivot-shaft 13. When feeding a sheet, the pivot tray 14 pivots to raise the sheet (the state illustrated in two-dot chain lines in FIG. 1). The separately feeding part 12 includes a pick-up roller 15 that feeds the sheet raised by the pivot tray 14 and a separation pad 16 that comes into pressure-contact with the pick-up roller 15.

The manual-feed unit 20 includes a manual-feed tray 21 on which sheets can be stacked and a separately feeding part 22 configured to separately feed a sheet stacked on the manual-feed tray 21 one by one. The manual-feed tray 21 is pivotally supported by the printer body 101. When sheets are fed manually, the manual-feed tray 21 pivots to a position where the sheets can be stacked thereon (the state illustrated in two-dot chain lines in FIG. 1). The separately feeding part 22 includes a feed roller 23 that feeds the sheets stacked on the manual-feed tray 21 and a separation pad 24 that comes into pressure-contact with the feed roller 23.

The image forming section 30 includes four processing cartridges (image forming units) 31Y to 31B for forming images of yellow (Y), magenta (M), cyan (C), and black (B), an exposure device 32 that exposes the surface of photoreceptor drums 310Y to 310B, which will be described later, a transfer section 33 that transfers the toner image formed on the surface of the photoreceptor drums 310Y to 310B to the sheet, and a fixing section 34 that fixes the toner image transferred to the sheet.

The four processing cartridges 31Y to 31B are each configured to be detachable to the printer body 101 so as to be replaceable. The four processing cartridges 31Y to 31B have the same configuration except the color of the image formed thereby. The description is made only for the configuration of the processing cartridge 31Y for forming a yellow (Y) image, and the description on the processing cartridges 31M to 31B is omitted. The last alphabet letter (Y, M, C, B) of each reference sign represents the color (yellow, magenta, cyan, and black).

The processing cartridge 31Y includes a photoreceptor drum 310Y which is an image carrier, an electrifying roller 311Y that electrifies the photoreceptor drum 310Y, a developing device 312Y that develops an electrostatic latent image formed on the photoreceptor drum 310Y, and a cleaner unit 313Y that removes the toner remaining on the surface of the photoreceptor drum 310Y. The developing device 312Y includes a developing device body 314Y that develops the photoreceptor drum 310Y and a toner cartridge 315Y that supplies toner to the developing device body 314Y. The toner cartridge 315Y is configured to be detachable to the developing device body 314Y. When the stored toner is used up, the toner cartridge 315Y is removed from the developing device body 314Y to be replaced. The toner cartridge 315Y will later be described in detail.

The exposure device 32 includes a light source 320 that emits a laser beam and a plurality of mirrors 321 or the like that guides the laser beam to the photoreceptor drums 310Y to 310B.

The transfer section 33 includes an intermediate transfer belt 330 that carries the toner image formed on the photoreceptor drums 310Y to 310B, primary transfer rollers 331Y to 331B that primarily transfer the toner image formed on the photoreceptor drums 310Y to 310B to the intermediate transfer belt 330, a secondary transfer roller 332 that secondarily transfers the toner image carried by the intermediate transfer belt 330 to a sheet, and a cleaner unit 333 that removes the toner remaining on the intermediate transfer belt 330. The intermediate transfer belt 330 is looped around a driving roller 334 and a driven roller 335. The primary transfer rollers 331Y to 331B press the intermediate transfer belt 330 onto the photoreceptor drums 310Y to 310B. The secondary transfer roller 332 nips (sandwiches) the intermediate transfer belt 330 in cooperation with the driving roller 334. The secondary transfer roller 332 transfers the toner image carried on the intermediate transfer belt 330 to the sheet at the nipping part N.

The fixing section 34 includes a heating roller 340 that heats the sheet and a pressing roller 341 that is pressed against the heating roller 340. The sheet discharge section 40 is configured with a pair of discharge rollers 41. The pair of discharge rollers 41 includes a discharge roller 42 that can normally and reversely rotate and a driven roller 43 that is rotatably driven by the discharge roller 42.

The controller 50 includes a sheet feeding section 10, a manual-feed unit 20, a CPU that performs drive control of the image forming section 30 and the sheet discharge section 40, and a memory that stores various types of programs and information. The controller 50 integrally controls and operates the sheet feeding section 10, the manual-feed unit 20, the image forming section 30, and the sheet discharge section 40 to form an image on the sheet.

Now, the image forming operation of the printer 100 thus configured (the control of image forming by the controller 50) will be described. For the embodiment, the image forming operation of forming an image on a sheet stacked on the feeding sheet stacking part 11 according to image information input from an external PC will described.

When image information is input from an external PC to the printer 100, the exposure device 32 emits a laser beam toward the photoreceptor drums 310Y to 310B according to the input image information. The photoreceptor drums 310Y to 310B are previously electrified by the electrifying rollers 311Y to 311B, and then irradiated with the laser beam to form electrostatic latent images thereon. The electrostatic latent images are developed (transformed into toner images) by the developing devices 312Y to 312B to form toner images of yellow (Y), magenta (M), cyan (C), and black (B) on the photoreceptor drums 310Y to 310B. The toner images of these respective colors formed on the photoreceptor drums 310Y to 310B are sequentially superimposed and transferred onto the intermediate transfer belt 330 rotating in the direction shown in the arrow A by the primary transfer rollers 331Y to 331B. The sequentially superimposed toner images, i.e. full color toner images, are conveyed to the secondary transfer roller 332 by the intermediate transfer belt 330.

In parallel with the image forming operation, the separately feeding part 12 feeds the sheet stacked on the feeding sheet stacking part 11, one by one, to the sheet conveyance path 102. A pair of registration rollers 103 located in the downstream of the sheet conveyance path 102 corrects the sheet to be straight, and the sheet is conveyed to the nipping part N at a predetermined timing of conveyance. When the sheet is conveyed to the nipping part N, the nipping part N transfers the toner image from the intermediate transfer belt 330 onto the sheet. The fixing section 34 melts the transferred toner image to fix the toner image onto the sheet. The sheet with the toner image fixed thereon is discharged out of the apparatus by the pair of discharge rollers 41. The sheet discharged out of the apparatus is stacked on the discharged sheet stacking section 104 provided on the top face of the printer body 101.

To form images on both faces (a first face and a second face) of the sheet, the sheet with an image formed on the first face (front face) thereof is conveyed, instead of discharging out to the discharged sheet stacking section 104, to a conveyance path for two-sided printing 105 by reversely rotating the discharge roller 42. The sheet is again conveyed to the image forming section 30 via the conveyance path for two-sided printing 105. Similarly to the first face, an image is formed on the second face (back face), and the sheet is discharged out of the apparatus.

Figure 2:
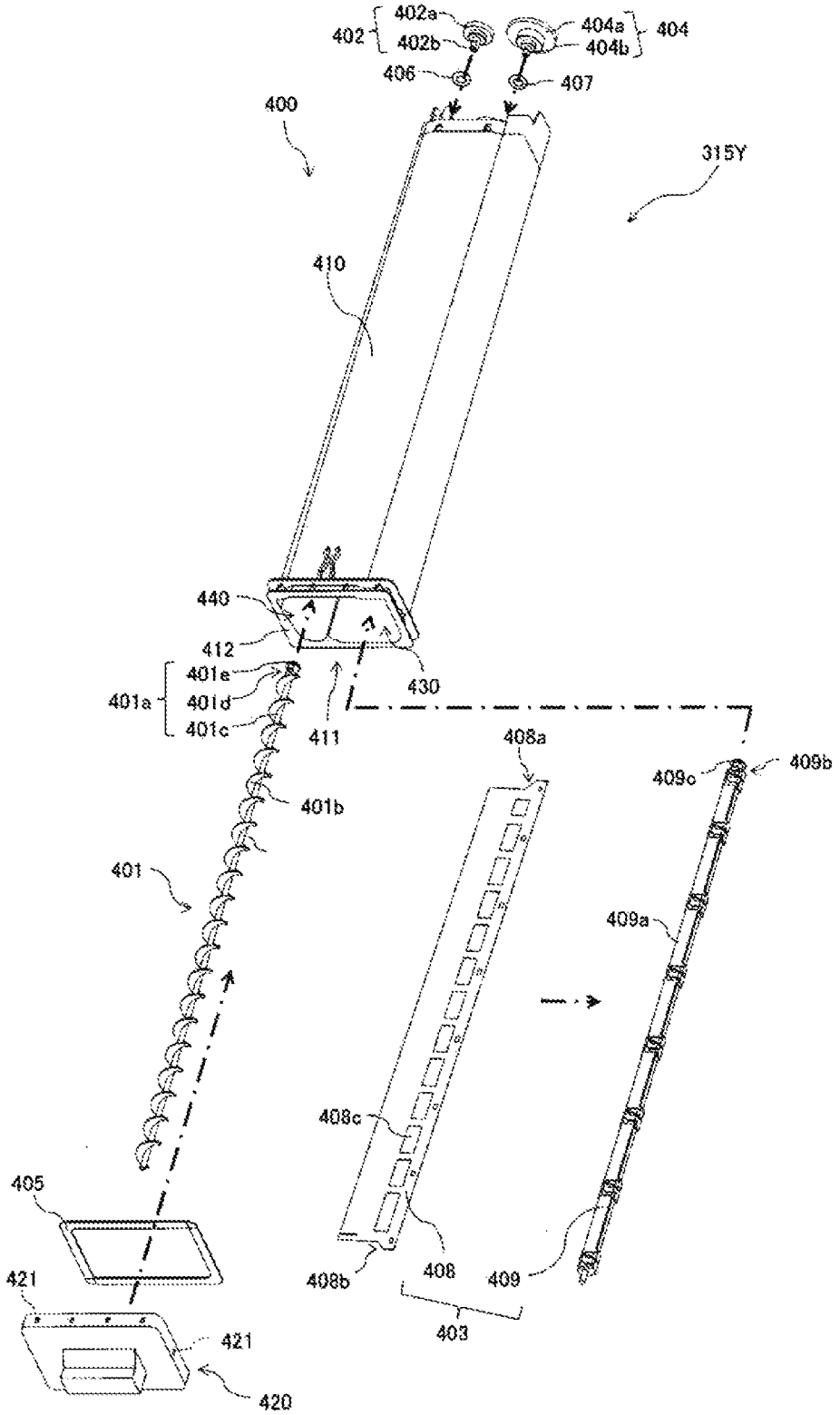
FIG. 2 is a figure illustrates an exploded assembly drawing of a toner cartridge of the printer according to the first embodiment.
Figure 4A:
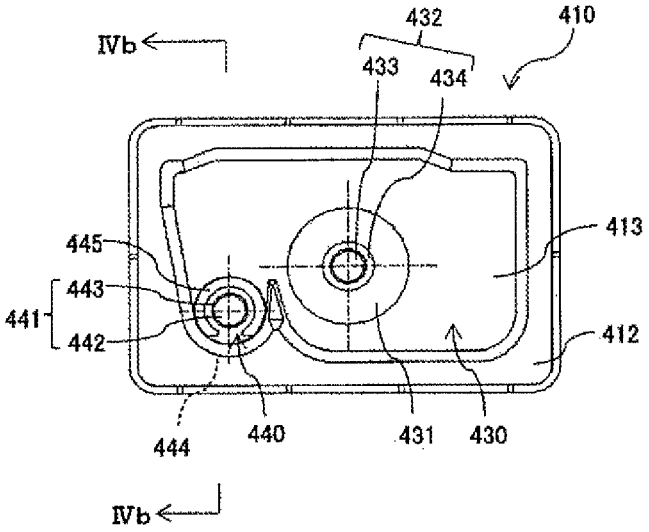
FIGS. 4A and 4B are figures illustrate a storage container body of the toner cartridge illustrated in FIG. 2.
Figure 4B:
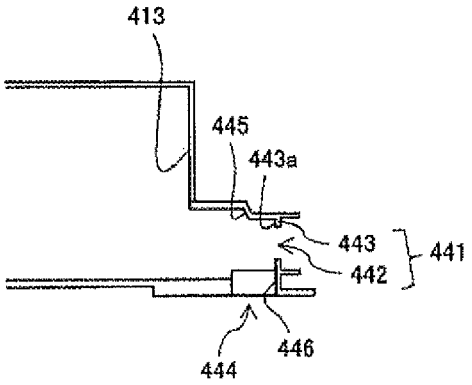
Figure 5A:
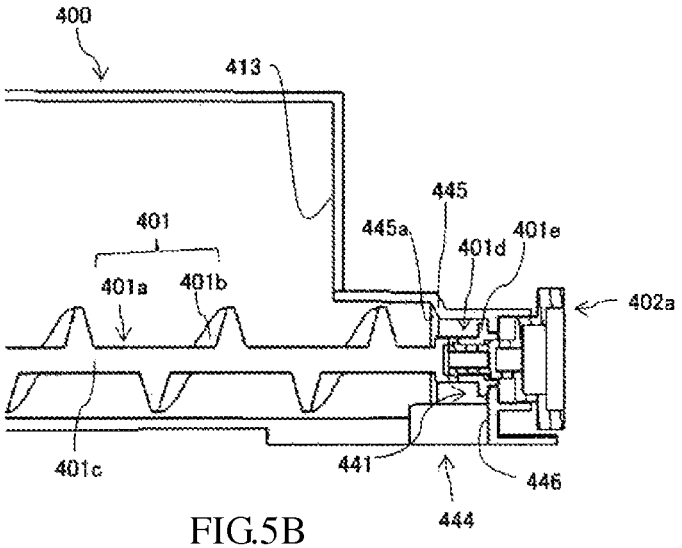
FIGS. 5A to 5C are figures illustrate the auger screw assembled to the storage container body.
Figure 5B:
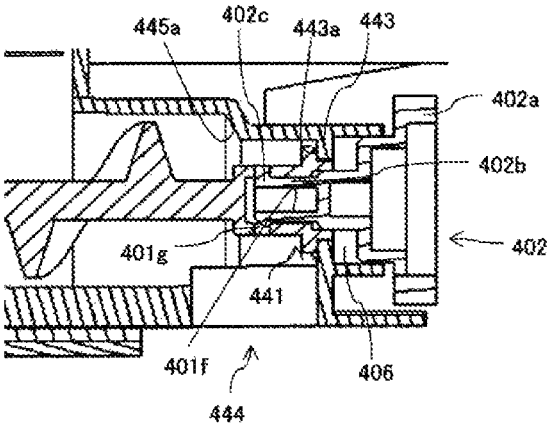
Figure 5C:
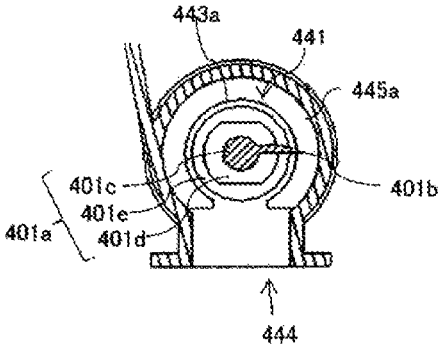
Figure 6A:
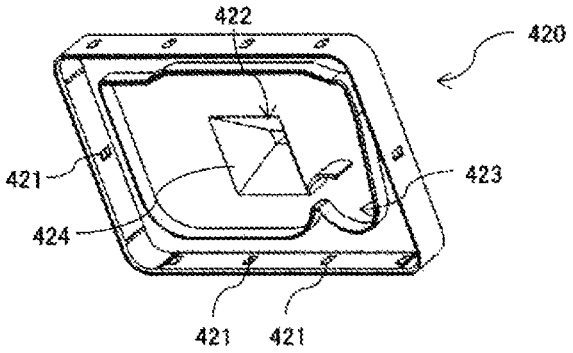
FIGS. 6A to 6C are figures illustrate a front cover of the toner cartridge illustrated in FIG. 2.
Figure 6B:
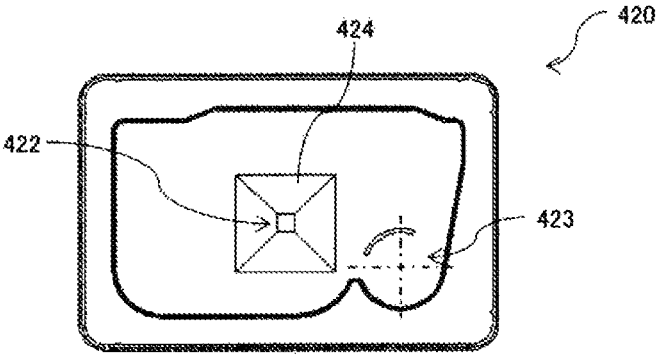
Figure 6C:
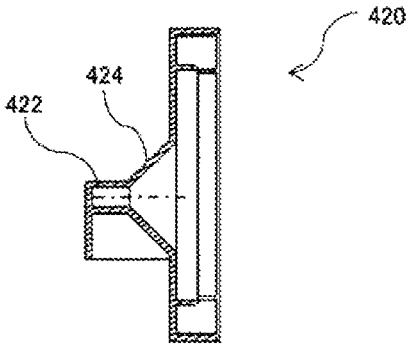

Now, the toner cartridge 315Y will specifically be described referring to FIGS. 2 to 6C. FIG. 2 is an exploded assembly drawing of the toner cartridge 315Y of the printer 100 according to the first embodiment. FIGS. 3A and 3B illustrate a stirring paddle 403 and an auger screw 401 contained in a toner storage container body 410 illustrated in FIG. 2. FIGS. 4A and 4B illustrate a storage container body 410 of the toner cartridge 315Y illustrated in FIG. 2. FIGS. 5A to 5C illustrate the auger screw 401 assembled to the storage container body 410. FIGS. 6A to 6C illustrate a front cover 420 of the toner cartridge 315Y illustrated in FIG. 2.

As illustrated in FIG. 2, the toner cartridge 315Y includes a toner storage container (toner storage case) 400 that stores toner, an auger screw 401 that conveys the toner stored in the toner storage container 400, a driving force transmitting gear (driving force transmitting unit) 402 that transmits the driving force from the driving source to the auger screw 401, a stirring paddle 403 that stirs the toner stored in the toner storage container 400, and a driving force transmitting gear 404 that transmits the driving force from the driving source to the stirring paddle 403.

The toner storage container 400 is formed in a sealed container having a substantially rectangular shape. The toner storage container 400 includes a storage container body (storage case body) 410 having an opening 411 at one of longitudinal ends and a front cover 420 that seals the opening 411 of the storage container body 410. The toner storage container 400 is sealed by attaching the front cover 420 to the storage container body 410 storing toner with a packing 405 assembled therebetween. The front cover 420 is assembled to the storage container body 410 by engaging a plurality of engaging claws 421 provided on the front cover 420 with the flange 412 provided on the periphery of the opening 411 of the storage container body 410.

Figure 3A:
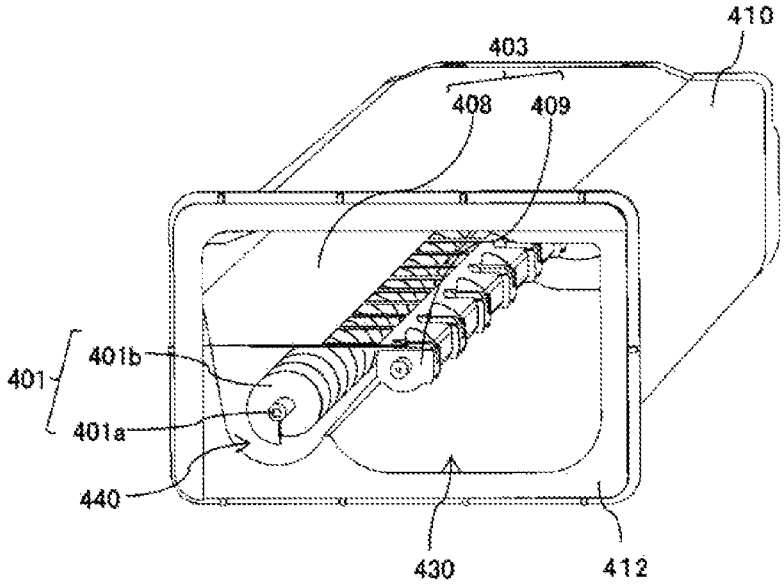
FIGS. 3A and 3B are figures illustrate a stirring paddle and an auger screw contained in a toner storage container body illustrated in FIG. 2.
Figure 3B:
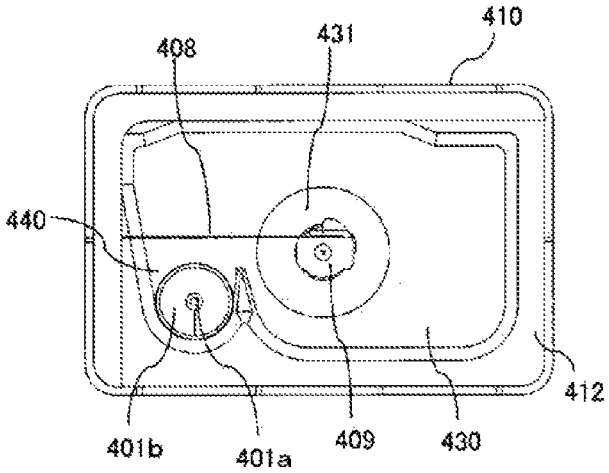

As illustrated in FIG. 3A, the storage container body 410 has therein a toner storage space 430 of a large volume in which the most of toner is stored and the stirring paddle 403 is disposed and a toner conveyance space 440 of a small volume that adjoins the toner storage space 430 and accommodates the auger screw 401 therein. The toner storage space 430 and the toner conveyance space 440 extend along the longitudinal direction of the storage container body 410. Thus, the auger screw 401 and the stirring paddle 403 are disposed along the longitudinal direction of the storage container body 410. The auger screw 401 and the stirring paddle 403 are inserted from the opening 411. As illustrated in FIG. 3B, the opening 411 has a size allowing the auger screw 401 and the stirring paddle 403 to be inserted therethrough.

As illustrated in FIG. 4A, a first tapered portion 431 is provided on an end 413 of the toner storage space 430, where the end 413 is located in the longitudinally opposite side of the opening 411. The first tapered portion 431 is tapered toward the direction opposite to the opening 411 along the longitudinal direction of the toner storage space 430. A paddle supporting portion 432 that rotatably supports one end of the stirring paddle 403 is provided on the distal end of the first tapered portion 431. The first tapered portion 431 is formed in a substantially conical shape to guide the rotating shaft 409 to the paddle supporting portion 432 when attaching the stirring paddle 403. The paddle supporting portion 432 has a through hole 433 that penetrates the storage container body 410 and allows the rotating shaft 409 of the stirring paddle 403 to be disposed therein and an engagement portion 434 configured to engage with a flange 409*c*, which will be described later, of the rotating shaft 409.

As illustrated in FIGS. 4A and 4B, the toner conveyance space 440 includes a screw supporting portion (first supporting portion) 441 on the end located longitudinally opposite to the opening 411 (on the downstream side along the toner conveyance direction). The screw supporting portion 441 rotatably supports the downstream end along the toner conveyance direction of the auger screw 401. The screw supporting portion 441 has a through hole 442 that penetrates the storage container body 410 and allows the rotating shaft 401*a* of the auger screw 401 to be disposed therein and an engagement portion 443 configured to engage with a flange 401*e* of the rotating shaft 401*a*, which will be described later. The through hole 442 is formed slightly larger than the diameter of the rotating shaft 401*a* of the auger screw 401 to allow the rotating shaft 401*a* to rotate. The engagement portion 443 includes an abutment face (end face) 443*a* that is perpendicular to the axial direction of the auger screw 401. The abutment face 443*a* abuts the flange 401*e* of the rotating shaft 401*a* as described below.

As illustrated in FIGS. 5A and 5B, a discharge port 444 is provided below the screw supporting portion 441 to discharge toner through a vertical wall 446. The discharge port 444 communicates with the developing device body 314Y (see FIG. 1). Above the discharge port 444, an inclined portion 445 is provided at a location offset by a predetermined distance to an upstream side along the toner conveyance direction from the abutment face 443*a*. The inclined portion 445 includes an inclined face 445*a* that takes a form of a partial circumferential-region not including the region adjacent to the discharge port 444. The entire inclined face 445*a* inclines, toward the rotating shaft 401*a* of the auger screw 401, along the toner conveyance direction. The partial circumferential-region has a substantially C-shape with its opening facing the bottom when viewed from the axial direction. The inclined face 445*a* has a substantially C-shape with its opening facing the bottom when viewed from the axial direction.

The inclined face 445*a* is formed in a tapered shape tapering toward the downstream along the toner conveyance direction. As illustrated in FIG. 5C, the inclined face 445*a* is provided in the region around the rotating shaft 401*a* not including the region between the rotating shaft 401*a* and the discharge port 444. Taking the abutment face 443*a* as a reference, the inclined portion 445 may preferably incline toward the upstream side along the toner conveyance direction by 25 to 60 degrees, more preferably 25 to 50 degrees. The inclined face 445*a* is preferably formed as large as possible without disturbing the abutment between the abutment face 443*a* and the flange 401*e*. By providing the inclined portion 445, the abutment face 443*a* at the downstream end along the toner conveyance direction can be downsized, and thus the leakage of toner from the screw supporting portion 441 can be prevented.

A shutter (not shown) that opens and closes the discharge port 444 is provided below the discharge port 444. The shutter is configured to open the discharge port 444 when the toner cartridge 315Y is attached to the developing device body 314Y, and to close the discharge port 444 when the toner cartridge 315Y is detached from the developing device body 314Y.

The front cover 420 is formed to seal the opening 411 of the storage container body 410. As illustrated in FIGS. 6A to 6C, the front cover 420 includes a paddle supporting portion 422 that rotatably supports the other end of the stirring paddle 403 and a screw supporting portion (second supporting portion) 423 that rotatably supports the upstream end along the toner conveyance of the auger screw 401. The paddle supporting portion 422 is provided to face the toner storage space 430. The paddle supporting portion 422 rotatably supports the stirring paddle 403, with the front cover 420 sealing the opening 411. A second tapered portion 424 that guides the stirring paddle 403 to the paddle supporting portion 422 is provided in the region around the paddle supporting portion 422. The second tapered portion 424 is formed in a substantially quadrangular pyramid shape. The screw supporting portion 423 is located at the distal end of the second tapered portion 424. The screw supporting portion 423 is provided to face the toner conveyance space 440. The screw supporting portion 423 rotatably supports the auger screw 401, with the front cover 420 sealing the opening 411.

The auger screw 401 includes the rotating shaft 401*a* rotatably supported by the toner storage container 400 and a spiral blade 401*b* that conveys toner toward the discharge port 444. The rotating shaft 401*a* includes a shaft body 401*c*, a coupling portion 401*d* that couples with the driving force transmitting gear 402, and a flange 401*e* that engages with the engagement portion 443. The coupling portion 401*d* includes an insertion hole 401*f* allowing the engaging claw 402*c* provided on the drive shaft 402*b* of the driving force transmitting gear 402 to be inserted therein. The insertion hole 401*f* has a engaged portion 401*g* that engages with the engaging claw 402*c*. That is, the drive shaft 402*b* of the driving force transmitting gear 402 is formed in a male-shape, and the coupling portion 401*d* of the auger screw 401 is formed in a female-shape. In such configuration, the driving force is transmitted to the auger screw and at the same time the leakage of toner can preferably be prevented.

The flange 401*e* is shaped to protrude from the outer circumferential face of the coupling portion 401*d* in the direction perpendicular to the axial direction. The flange 401*e* engages with the engagement portion 443, thereby axially positioning the coupling portion 401*d* disposed in the through hole 442. The driving force transmitting gear 402 includes a gear part 402*a* that meshes with the driving force transmitting gear 404 and a drive shaft 402*b* provided around the rotation axis of the gear part 402*a*. A sealing member 406 is arranged between the driving force transmitting gear 402 and the engagement portion 443. The sealing member 406 prevents toner from leaking from the toner conveyance space 440. The driving force transmitting unit is not limited to the driving force transmitting gear 402. For example, a timing belt may be used.

The stirring paddle 403 includes a stirring blade 408 that stirs toner and a rotating shaft 409 that rotates the stirring blade 408. The stirring blade 408 includes a first inclined portion 408*a* (see FIG. 6A) and a second inclined portion 408*b* (see FIG. 2). The first inclined portion 408*a* is formed to have an edge substantially parallel to the inclined angle of the first tapered portion 431 provided in the toner storage space 430 of the storage container body 410 so as to fit along the first tapered portion 431. The second inclined portion 408*b* is formed to have an edge substantially parallel to the inclined angle of the second tapered portion 424 provided on the front cover 420 so as to fit along the second tapered portion 424. Provided with the first inclined portion 408*a* and the second inclined portion 408*b*, the stirring blade 408 can rake out and stir the toner that intrudes into the first tapered portion 431 and the second tapered portion 424. Thus, the stored toner can further efficiently be used. The stirring blade 408 includes a plurality of openings 408*c* to reduce the resistance force produced by stirring. The plurality of openings 408*c* reduces the load on the stirring paddle 403.

The rotating shaft 409 includes a shaft body 409*a*, a coupling portion 409*b* that couples with the driving force transmitting gear 404, and a flange 409*c* that engages with the engagement portion 434. The coupling portion 409*b* includes an insertion hole allowing the engaging claw provided on the drive shaft 404*b* of the driving force transmitting gear 404 to be inserted therein. The insertion hole 409*d* has a engaged portion that engages with the engaging claw. That is, the drive shaft 404*b* of the driving force transmitting gear 404 is formed in a male-shape, and the coupling portion 409*b* of the stirring paddle 403 is formed in a female-shape. The flange 409*c* is shaped to protrude from the outer circumferential face of the coupling portion 409*b* in the direction perpendicular to the axial direction. The flange 409*c* serves, such as, to axially position the coupling portion 409*b* disposed in the through hole 433. The driving force transmitting gear 404 includes a gear part 404*a* that is coupled to the driving source and a drive shaft 404*b* provided on the rotating shaft of the gear part 404*a*. A sealing member 407 is arranged between the driving force transmitting gear 404 and the engagement portion 434. The sealing member 407 prevents toner from leaking from the toner storage space 430.

As described above, the toner cartridge 315Y of the printer 100 according to the first embodiment includes the inclined face 445*a* that is provided above the discharge port 444 of the toner storage container 400 and inclines by a predetermined angle from an abutment face 443*a* toward the upstream side along the toner conveyance direction. So that the toner conveyed to the downstream end along the toner conveyance direction by the auger screw 401 can easily fall toward the discharge port 444. This prevents the toner accumulating at the downstream end along the toner conveyance direction to become dense (condensed). As a result, an excessive load applied on the auger screw 401 can be avoided, and the locking of the driving force transmitting gear 402 or deformation and damaging of the spiral blade 401*b* of the auger screw 401 or the like can be prevented. Furthermore, the configuration prevents the auger screw from stopping its rotation due to an excessive load, thereby preventing tooth-skipping that might occur at driving force transmitting units.

In the toner cartridge 315Y according to the embodiment, the inclined face 445*a* has an inclined angle of 25 to 50 degrees. The inclined angle of 25 to 50 degrees preferably reduces the load applied on the auger screw 401, thereby providing a stable conveyance of toner by the auger screw 401. Furthermore, by setting the inclined angle to 25 to 50 degrees, the toner cartridge 315Y does not become excessively long, so that the strength along the longitudinal direction of the toner cartridge 315Y is sufficiently maintained.

In the toner cartridge 315Y according to the embodiment, the inclined face 445*a* is formed in a substantially tapered shape tapering toward the downstream along the toner conveyance direction. So that the toner conveyed by the auger screw 401 is guided along the inclined angle of the inclined face 445*a* to the discharge port 444. The toner is thus easily discharged from the discharge port 444. As a result, the accumulation of toner is reduced, and the auger screw 401 can stably convey toner.

Second Embodiment

Figure 7:
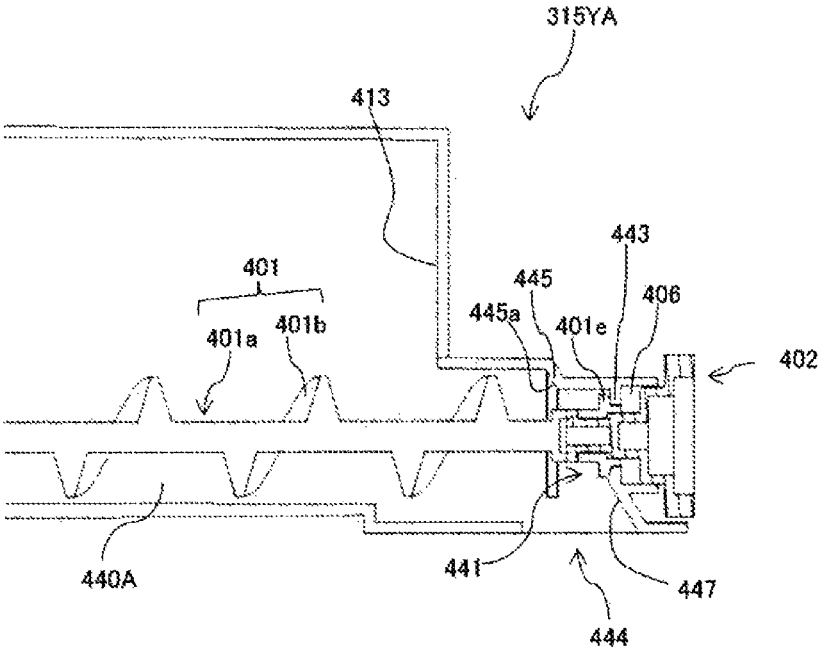
FIG. 7 is a figure illustrates a partially enlarged cross sectional view of the toner cartridge according to the second embodiment of the present invention.

A printer 100A according to a second embodiment of the present invention will be described referring to FIG. 7 while quoting FIG. 1. FIG. 7 is a partially enlarged cross sectional view of a toner cartridge 315YA according to the second embodiment. The printer 100A according to the second embodiment is different from the first embodiment in that an inclined wall 447 is provided in place of the vertical wall 446 of a toner cartridge. Description is made for the second embodiment mainly on the portion different from the first embodiment, that is, on the inclined wall 447. The component configured similarly to that of the first embodiment is appended with the same reference sign, and the description thereof is omitted.

As illustrated in FIG. 1, the printer 100A includes a sheet feeding section 10, a manual-feed unit 20, an image forming section 30A, a sheet discharge section 40, and a controller 50. The image forming section 30A includes four processing cartridges (image forming units) 31YA to 31BA, an exposure device 32, a transfer section 33, and a fixing section 34. The processing cartridge 31YA includes a photoreceptor drum 310Y, an electrifying roller 311Y, a developing device 312YA, and a cleaner unit 313Y. The developing device 312YA includes a developing device body 314Y and a toner cartridge 315YA.

The toner cartridge 315YA includes a toner storage container (toner storage case) 400A storing toner, an auger screw 401, a driving force transmitting gear 402, a stirring paddle 403, and a driving force transmitting gear (driving unit) 404. The toner storage container 400A is formed in a sealed container having a substantially rectangular shape and includes a storage container body 410A having an opening 411 on a longitudinal end and a front cover 420.

The storage container body 410A includes a toner storage space 430 and a toner conveyance space 440A of a small volume that adjoins the toner storage space 430 and accommodates the auger screw 401 therein. As illustrated in FIG. 7, the toner conveyance space 440A includes a screw supporting portion (first supporting portion) 441 at the downstream end along the toner conveyance direction. A discharge port 444 is provided below the screw supporting portion 441 with the inclined wall 447 therebetween. The inclined wall 447 has a substantially same inclined angle as that of the inclined portion 445 (substantially parallel to the inclined portion 445).

As described above, the toner cartridge 315YA according to the second embodiment includes the discharge port 444 provided below the screw supporting portion 441 with the inclined wall 447 therebetween. So that the discharge port 444 can be made large, and thus the toner conveyed to the inclined wall 447 by the auger screw 401 easily falls into the discharge port 444. In this manner, an excessive load applied to the auger screw is avoided.

Third Embodiment

Figure 8:
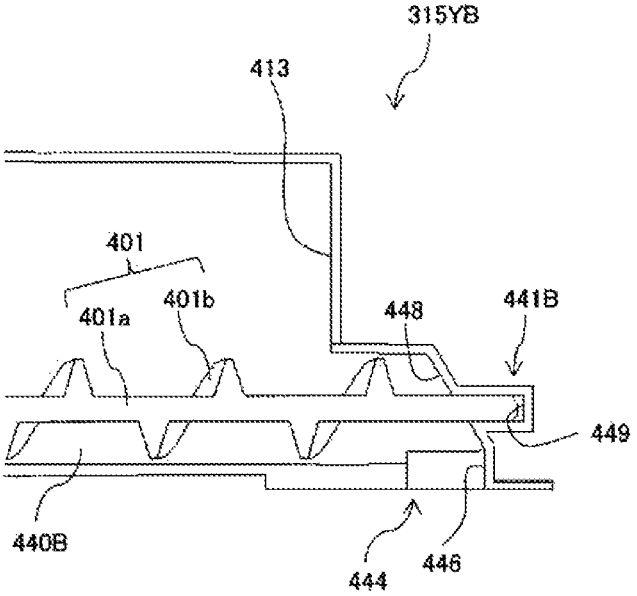
FIG. 8 is a figure illustrates a partially enlarged cross sectional view of the toner cartridge according to the third embodiment of the present invention.

A printer 100B according to a third embodiment of the present invention will be described referring to FIG. 8 while quoting FIG. 1. FIG. 8 is a partially enlarged cross sectional view of a toner cartridge 315YA according to the third embodiment. The printer 100B according to the third embodiment is different from the first embodiment in that a different screw supporting portion of the toner cartridge is included. Description is made for the third embodiment mainly on the portion different from the first embodiment, that is, on the screw supporting portion. The component configured similarly to that of the first embodiment is appended with the same reference sign, and the description thereof is omitted.

As illustrated in FIG. 1, the printer 100B includes a sheet feeding section 10, a manual-feed unit 20, an image forming section 30B, a sheet discharge section 40, and a controller 50. The image forming section 30B includes four processing cartridges (image forming units) 31YB to 31BB, an exposure device 32, a transfer section 33, and a fixing section 34. The processing cartridge 31YB includes a photoreceptor drum 310Y, an electrifying roller 311Y, a developing device 312YB, and a cleaner unit 313Y. The developing device 312YB includes a developing device body 314Y and a toner cartridge 315YB.

The toner cartridge 315YB includes a toner storage container (toner storage case) 400B storing toner, an auger screw 401, a driving force transmitting gear 402, a stirring paddle 403, and a driving force transmitting gear 404. The toner storage container 400B is formed in a sealed container having a substantially rectangular shape and includes a storage container body 410B having an opening 411 on a longitudinal end and a front cover 420B that seals the opening 411 of the storage container body 410B.

The storage container body 410B has a toner storage space 430B of a large volume in which the stirring paddle 403 is disposed and the most of toner is stored and a toner conveyance space 440B of a small volume that adjoins the toner storage space 430B and accommodates the auger screw 401 therein. The first tapered portion 431 is provided on an end 413 of the toner storage space 430B, where the end 413 is located in the longitudinally opposite side of the opening 411. The first tapered portion 431 is tapered toward the direction opposite to the opening 411 along the longitudinal direction. A paddle supporting portion 432B that rotatably supports one end of the stirring paddle 403 is provided on the distal end of the first tapered portion 431.

As illustrated in FIG. 8, the toner conveyance space 440B includes a screw supporting portion (first supporting portion) 441B on the downstream end along the toner conveyance direction. The screw supporting portion 441B rotatably supports the downstream end along the toner conveyance direction of the rotating shaft 401*a* of the auger screw 401. A discharge port 444 is provided below the screw supporting portion 441B with the vertical wall 446 therebetween. An inclined wall 448 that inclines by a predetermined angle is provided above the discharge port 444 at the downstream end along the toner conveyance direction. The inclined wall 448 has a planar face and formed to have an area if seen from the discharge port 444 perpendicularly to the discharge port 444.

Taking the abutment face 449 of the screw supporting portion 441B abutting the auger screw 401 as a reference, the inclined portion 448 preferably inclines toward the upstream side along the toner conveyance direction by 25 to 60 degrees, more preferably 25 to 50 degrees.

The front cover 420B includes a paddle supporting portion 422B that rotatably supports the other end of the stirring paddle 403 and a screw supporting portion 423B that rotatably supports the upstream end along the toner conveyance of the auger screw 401. The driving force transmitting gear 404 is arranged on the paddle supporting portion 422B. The driving force transmitting gear 404 transmits a driving force through the front cover 420B to the auger screw 401. The driving force transmitting gear 402 is arranged on the screw supporting portion 423B. The driving force transmitting gear 402 transmits a driving force through the front cover 420B to the stirring paddle 403.

As described above, in the toner cartridge 315YB according to the third embodiment, the front cover 420B arranged in the upstream side along the toner conveyance direction is arranged with the driving force transmitting gear 402 that drives the auger screw 401. Thus, the downstream end along the toner conveyance direction of the toner conveyance space 440B can be provided as the inclined wall 448. In this manner, the toner conveyed by the auger screw 401 can easily fall, and the state in which the toner pressed against the inclined wall 448 to become dense can be avoided. As a result, an excessive load applied on the auger screw 401 can be avoided.

EXAMPLE

For the toner cartridge 315Y according to the first embodiment, the difference in the torque applied on the auger screw 401 according to the variation of the inclined angle of the inclined portion 445 of the toner storage container 400 will be described in detail.

First Example

A toner cartridge similar to the toner cartridge 315Y according to the first embodiment which includes the inclined portion 445 with the inclined angle of 25 degrees was prepared. The storage container body is filled with toner and sealed with the front cover. With the discharge port facing downward, the toner cartridge is tapped 200 times, and the toner is blocked at the downstream side along the toner conveyance direction. A motor of allowable torque of 100 N·cm is coupled to the toner cartridge to rotate the stirring paddle and the auger screw. The angle of the spiral blade of the auger screw is about 16 degrees. The driving torque of the auger screw was measured with a driving torque measuring device. The measured driving torque is shown in Table 1.

First Comparative Example

A toner cartridge similar to the toner cartridge 315Y according to the first embodiment which includes the inclined portion 445 with the inclined angle of 5 degrees was prepared. The driving torque of the auger screw was measured in a manner similar to the first example. The measured driving torque is shown in Table 1. As shown in Table 1, in the case where the inclined portion has an inclined angle of 5 degrees, the driving torque of the auger screw is 100 N·cm or higher, which might cause a damage to the driving force transmitting gear or the like.

Second Comparative Example

A toner cartridge similar to the toner cartridge 315Y according to the first embodiment which includes the inclined portion 445 with the inclined angle of 10 degrees was prepared. The driving torque of the auger screw was measured with the driving torque measuring device in a manner similar to the first example. The measured driving torque is shown in Table 1. As shown in Table 1, in the case where the inclined portion has an inclined angle of 10 degrees, the driving torque of the auger screw is 100 N·cm or higher, which might cause a damage to the driving force transmitting gear or the like.

Third Comparative Example

A toner cartridge similar to the toner cartridge 315Y according to the first embodiment which includes the inclined portion 445 with the inclined angle of 15 degrees was prepared. The driving torque of the auger screw was measured with the driving torque measuring device in a manner similar to the first example. The measured driving torque is shown in Table 1. As shown in Table 1, in the case where the inclined portion has an inclined angle of 15 degrees, the driving torque of the auger screw is 92 N·cm, which might cause condensation of toner due to torque stress.

TABLE 1

| Measured Torque after Tapping 200 Times | | | | |
|---|---|---|---|---|
| | Taper Angle | Result | Driving Torque | Remark |
| First Comparative Example | 5° | Unacceptable | 100 N · cm or higher | Driving gear damaged. No decrease in torque. |
| Second Comparative Example | 10° | Unacceptable | 100 N · cm or higher | Driving gear damaged. No decrease in torque. |
| Third Comparative Example | 15° | Not Preferable | 92 N · cm | Toner might condense by torque stress. |
| Fourth Comparative Example | 20° | Not Preferable | 88 N · cm | Toner might condense by torque stress. |
| First Example | 25° | Preferable | 80 N · cm | Torque decreased by about 20%. |
| Second Example | 30° | Preferable | 73 N · cm | Torque decreased by about 30%. |
| Third Example | 35° | Preferable | 63 N · cm | Torque decreased by about 40%. |
| Fourth Example | 40° | Preferable | 55 N · cm | Torque decreased by about 45%. |
| Fifth Example | 45° | Preferable | 49 N · cm | Torque decreased by about 50%. |
| Sixth Example | 50° | Preferable | 45 N · cm | Torque decreased by about 55%. |
| Fifth Comparative Example | 55° | Not Preferable | 40 N · cm | Strength of the unit decreases, due to a longer protruding portion for discharging toner. |
| Sixth Comparative Example | 60° | Not Preferable | 38 N · cm | Strength of the unit decreases, due to a longer protruding portion for discharging toner. |

*Allowable Torque of Motor: 100 N · cm

As shown in Table 1, in the case where the inclined portion has an inclined angle of 25 degrees, the torque applied on the auger screw was 80 N·cm. For this case, the driving torque of the auger screw is about 20% lower than the allowable torque of the motor.

Fourth Comparative Example

A toner cartridge similar to the toner cartridge 315Y according to the first embodiment which includes the inclined portion 445 with the inclined angle of 20 degrees was prepared. The driving torque of the auger screw was measured with the driving torque measuring device in a manner similar to the first example. The measured driving torque is shown in Table 1. As shown in Table 1, in the case where the inclined portion has an inclined angle of 20 degrees, the driving torque of the auger screw is 88 N·cm, which might cause condensation of toner due to torque stress.

Second Example

A toner cartridge similar to the toner cartridge 315Y according to the first embodiment which includes the inclined portion 445 with the inclined angle of 30 degrees was prepared. The driving torque of the auger screw was measured with the driving torque measuring device in a manner similar to the first example. The measured driving torque is shown in Table 1. As shown in Table 1, in the case where the inclined portion has an inclined angle of 30 degrees, the torque applied on the auger screw was 73 N·cm. For this case, the driving torque of the auger screw is about 30% lower than the allowable torque of the motor.

Third Example

A toner cartridge similar to the toner cartridge 315Y according to the first embodiment which includes the inclined portion 445 with the inclined angle of 35 degrees was prepared. The driving torque of the auger screw was measured with the driving torque measuring device in a manner similar to the first example. The measured driving torque is shown in Table 1. As shown in Table 1, in the case where the inclined portion has an inclined angle of 35 degrees, the torque applied on the auger screw was 63 N·cm. For this case, the driving torque of the auger screw is about 40% lower than the allowable torque of the motor.

Fourth Example

A toner cartridge similar to the toner cartridge 315Y according to the first embodiment which includes the inclined portion 445 with the inclined angle of 40 degrees was prepared. The driving torque of the auger screw was measured with the driving torque measuring device in a manner similar to the first example. The measured driving torque is shown in Table 1. As shown in Table 1, in the case where the inclined portion has an inclined angle of 40 degrees, the torque applied on the auger screw was 55 N·cm. For this case, the driving torque of the auger screw is about 45% lower than the allowable torque of the motor.

Fifth Example

A toner cartridge similar to the toner cartridge 315Y according to the first embodiment which includes the inclined portion 445 with the inclined angle of 45 degrees was prepared. The driving torque of the auger screw was measured with the driving torque measuring device in a manner similar to the first example. The measured driving torque is shown in Table 1. As shown in Table 1, in the case where the inclined portion has an inclined angle of 45 degrees, the torque applied on the auger screw was 49 N·cm. For this case, the driving torque of the auger screw is about 50% lower than the allowable torque of the motor.

Sixth Example

A toner cartridge similar to the toner cartridge 315Y according to the first embodiment which includes the inclined portion 445 with the inclined angle of 50 degrees was prepared. The driving torque of the auger screw was measured with the driving torque measuring device in a manner similar to the first example. The measured driving torque is shown in Table 1. As shown in Table 1, in the case where the inclined portion has an inclined angle of 50 degrees, the torque applied on the auger screw is 45 N·cm. For this case, the driving torque of the auger screw is about 55% lower than the allowable torque of the motor.

Fifth Comparative Example

A toner cartridge similar to the toner cartridge 315Y according to the first embodiment which includes the inclined portion 445 with the inclined angle of 55 degrees was prepared. The driving torque of the auger screw was measured with the driving torque measuring device in a manner similar to the first example. The measured driving torque is shown in Table 1. As shown in Table 1, in the case where the inclined portion has an inclined angle of 55 degrees, the torque applied on the auger screw was 40 N·cm. For this case, the driving torque of the auger screw is about 60% lower than the allowable torque of the motor. Meanwhile, in the case where the inclined portion has an inclined angle of 55 degrees, the portion protruding from the end 413 of the toner storage space 430 becomes long, which might degrade the strength.

Sixth Comparative Example

A toner cartridge similar to the toner cartridge 315Y according to the first embodiment which includes the inclined portion 445 with the inclined angle of 60 degrees was prepared. The driving torque of the auger screw was measured with the driving torque measuring device in a manner similar to the first example. The measured driving torque is shown in Table 1. As shown in Table 1, in the case where the inclined portion has an inclined angle of 60 degrees, the torque applied on the auger screw was 38 N·cm. For this case, the driving torque of the auger screw is about 60% lower than the allowable torque of the motor. Meanwhile, in the case where the inclined portion has an inclined angle of 60 degrees, the portion protruding from the end 413 of the toner storage space 430 becomes long, which might degrade the strength.

From the result above, it can be understood that the driving torque of the auger screw 401 can preferably be reduced by setting the inclined angle to 25 to 50 degrees for the inclined portion 445 of the toner cartridge 315Y. Accordingly, the accumulation of toner at the downstream along the toner conveyance direction is reduced.

What is claimed is:

1. A toner cartridge comprising:

a toner storage case that stores toner; and an auger screw that is rotatably supported in the toner storage case, the auger screw conveys the toner stored in the toner storage case, wherein the toner storage case includes:

a first supporting portion that rotatably supports a downstream end along a toner conveyance direction of the auger screw;

a second supporting portion that rotatably supports an upstream end along the toner conveyance direction of the auger screw;

a discharge port that discharges therefrom the toner conveyed by the auger screw, the discharge port being provided at a position which is at a downstream side along the toner conveyance direction and spaced from a predetermined side of the first supporting portion; and an inclined portion including an inclined flat surface which is provided between the first supporting portion and the discharge port such that the inclined flat surface extends to meet the discharge port at an inclined angle relative to a longitudinal dimension of the discharge port.

2. The toner cartridge according to claim 1, wherein the inclined portion inclines by an angle of 25 to 50 degrees from a plane perpendicular to an axial direction of the rotating shaft of the auger screw.

3. The toner cartridge according to claim 1, further comprising:

a driving force transmitter that transmits a driving force to the auger screw, wherein the rotating shaft of the auger screw includes:

a shaft body;

a coupling portion provided at a downstream end along the toner conveyance direction to be coupled to the driving force transmitter; and a flange protruding from the coupling portion in a direction perpendicular to an axial direction, the first supporting portion includes:

an engagement portion that engages with the flange; and a through hole allowing the coupling portion to penetrate therethrough from inside to outside the toner storage case, and the driving force transmitter couples from outside the toner storage case with the coupling portion penetrating the toner storage case, with the flange and the engagement portion engaging with each other.

4. The toner cartridge according to claim 3, wherein the through hole is formed in a size that provides a predetermined allowance between the through hole and the coupling portion disposed in the through hole, and a sealing member is arranged between the engagement portion of the first supporting portion and the driving force transmitter.

5. The toner cartridge according to claim 3, wherein the driving force transmitter includes:

a gear part; and a drive shaft provided around a rotation axis of the gear part to be coupled to the coupling portion.

6. The toner cartridge according to claim 5, wherein the drive shaft is formed in a male-shape and the coupling portion is formed in a female-shape.

7. An image forming unit comprising:

a photoreceptor drum on which an electrostatic latent image is formed; and a developing device that develops the electrostatic latent image formed on the photoreceptor drum into a toner image, wherein the developing device includes:

a developing device body; and the toner cartridge according to claim 1 that supplies the toner therein to the developing device body.

8. The image forming unit according to claim 7, wherein the toner cartridge is detachably connected to the developing device body.

9. An image forming apparatus comprising:

an image forming section including the image forming unit according to claim 7, a transfer section that transfers the toner image formed by the image forming unit onto a sheet, and a fixing section that fixes the toner image transferred onto the sheet; and a sheet feeding section that feeds the sheet to the image forming section.

10. The toner cartridge according to claim 1, wherein the inclined flat surface extends to a side of the auger screw that is farthest from the discharge port.

11. The toner cartridge according to claim 1, wherein the toner advances toward the discharge port as the toner moves downward along the auger screw on the inclined flat surface until the toner is discharged from the discharge port.

* * * * *